United States Patent [19]

Gregory

[11] Patent Number: 4,790,113

[45] Date of Patent: Dec. 13, 1988

[54] ADJUSTABLE DEPTH TRUSS

[76] Inventor: Robert K. Gregory, 1110 Eikel, Ste. E, New Braunfels, Tex. 78130

[21] Appl. No.: 63,724

[22] Filed: Jun. 16, 1987

Related U.S. Application Data

[63] Continuation of Ser. No. 831,368, Feb. 18, 1986, abandoned.

[51] Int. Cl.[4] ..... E04H 12/18

[52] U.S. Cl. ..... 52/646; 52/648; 52/693; 249/28

[58] Field of Search ..... 52/637, 645, 646, 650, 52/665, 692, 663, 648, 126.6, 693; 249/24, 28

[56] References Cited

U.S. PATENT DOCUMENTS

| | | | |
|---|---|---|---|
| 2,152,189 | 3/1939 | Henderson | 52/645 X |
| 2,284,898 | 6/1942 | Hartman | 52/650 |
| 3,007,232 | 11/1961 | Thiry | 52/645 X |
| 3,327,987 | 6/1967 | Müller | 52/665 X |
| 3,438,160 | 4/1969 | Gostling | 52/646 X |
| 3,826,057 | 7/1974 | Franklin | 52/693 X |
| 4,106,256 | 8/1978 | Cody | 52/646 |
| 4,416,102 | 11/1983 | Peters | 52/692 |
| 4,546,591 | 10/1985 | Beltz | 52/645 |

FOREIGN PATENT DOCUMENTS

| | | | |
|---|---|---|---|
| 1062870 | 9/1979 | Canada | 52/693 |
| 63662 | 11/1982 | European Pat. Off. | 52/645 |
| 808643 | 2/1981 | U.S.S.R. | 52/665 |

*Primary Examiner*—David A. Scherbel
*Assistant Examiner*—Richard E. Chilcot, Jr.
*Attorney, Agent, or Firm*—Cox & Smith Inc.

[57] ABSTRACT

An adjustable depth truss for a flying table comprised of an upper and lower chord held in spaced relationship to each other by diagonal supports attached by connectors received within holes spaced along the length of the chords. The connectors are selectively positionable in the holes to change the angle at which the diagonals are mounted to the chords, thereby varying the distance between the chords and adjusting the depth of the truss.

12 Claims, 2 Drawing Sheets

ADJUSTABLE DEPTH TRUSS

This application is a continuation of my co-pending application Ser. No. 831,368, filed on Feb. 18, 1986, now abandoned.

BACKGROUND OF THE INVENTION

The present invention relates to an adjustable depth truss for use in such applications as supporting a horizontal concrete form. More particularly, the present invention relates to an adjustable depth truss used in a flying table.

In the art of construction, a great variety of concrete forms are used. One common form is a horizontal deck form for pouring concrete flooring in multi-story buildings. To add another story to the building, a deck form is placed on top of the previously poured floor, and concrete is poured on top of the form to construct the next highest floor. These forms are usually called "flying tables", because, after the new floor has set, the form is lowered away from the new ceiling, transported to the edge of the building, and "flown" to the floor above to support another pour.

Normally, flying tables are constructed with a metal truss, the truss being supported by a jack stand or leg resting on a support surface such as the previously poured floor. To move the flying table, the truss is lowered on the jack and the entire form is moved on rollers to the edge of the building where it is picked up by a crane and flown to the next floor.

The trusses which form part of conventional flying tables suffer from a number of disadvantages and limitations which hamper their utility. First, because the depth of the truss is not adjustable, the height of the flying table above the support surface of previous pour is limited to the extent that the adjsutability of the jack stand or leg allow. Because the height variability of the flying table is limited to the range of the jack and/or leg, which is a relatively limited range, it is difficult to pour floors which are more than a certain height above the support surface or previous pour. Second, conventional flying tables are constructed of steel or aluminum to provide sufficient strength. However, the use of steel makes the flying tables relatively heavy, requiring either that they be broken into sections to be moved from one floor to another (i.e., handset) or that a very large crane be used to fly the entire form. Larger cranes are more expensive to operate than the smaller cranes and may be prohibited by space constraints. Of course, handset forms must be repeatedly assembled and disassembled, which is labor intensive and slow. Finally, metal flying tables are expensive.

Another limitation of known trusses is that they do not have any interchangeable components which would allow the use of those components on other forms or devices used in construction, such as scaffolds or gangforms. Further, they are available only in certain sizes and are not, therefore, easily adaptable for use in a particular situation. A significant savings in cost and reduction in inventory requirements would be realized if the components of the flying table could be interchanged with the components of other types of concrete forming, for instance, if the chords of the truss are interchangeable with the joists of a flying table or the studs and walers of a gangform. In addition to that cost saving, the ability to assemble and disassemble a truss into a desired size and length would add significant flexibility of use which would likewise result in a significant cost saving.

Aluminum trusses are available which help to overcome the weight problem, but they are much more expensive than steel trusses and do not have any components which are specifically designed to be interchangeable with the components of other forms. Further, the depth of those aluminum trusses is not adjustable, which limits their utility. One attempt to solve that problem is currently being marketed in the form of a double channel aluminum extrusion truss which is adjustable in only one mode. An extendable leg is bolted between the channels of the bottom chord of that truss stand and attached to two adjacent diagonals to take the place of the jack. However, this leg is for adjustment of the height of the truss and not the depth. The double channel chord member of that truss can be used as a waler, but the thin web of that member limits its bearing capacity thereby limiting its use in this matter such that it is not truly interchangeable with other components.

Using lumber trusses reduces the initial cost of the materials, especially when that cost is compared to the cost of aluminum. Further, lumber is relatively light in weight and can be handled by smaller cranes. However, lumber components are normally job-site constructed for each use by nailing the wood together. Nail joinery is not strong enough for heavy loads, which leads to the use of many more nails, which further damages the wood. Consequently, lumber trusses have a limited capacity for reuse.

It is, therefore, an object of the present invention to provide a light weight and low cost truss, capable of being assembled and disassembled repeatedly without damage, and having components which are interchangeable with the components of other concrete forms.

It is another object of the present invention to provide a truss which is capable of being conveniently adapted for use in a wide variety of applications, thereby reducing the number and types of truss components which must be kept in inventory by the contractor.

It is another object of the present invention to provide an adjustable depth truss.

Further, it is an object of the present invention to provide a truss which can be used as a component of a light weight flying table deck form.

Further, it is an object of the present invention to provide a flying table whose components can be used as components of other forms or devices for forming.

Further, it is an object of the present invention to lower the accessory inventory costs for contractors.

Further, it is an object of the present invention to employ accessories for assembly of flying tables which are identical to the accessories for assembly of gangforms and for scaffolds, such as connector hardware, hookrods and brackets.

Further, it is an object of the present invention to provide a truss of light weight to decrease the size of the crane necessary to fly a flying table.

These and other objects of the present invention will become evident to those skilled in the art who have the benefit of the description of the preferred embodiment which follows.

SUMMARY OF THE INVENTION

The invention is an adjustable depth truss comprising an upper chord and a lower chord, each of the chords having a plurality of holes spaced along the length thereof, and a plurality of diagonal supports, each of the diagonal supports being mounted at one end to a connector received within one of the holes in the upper chord and at the other end to a connector received within one of the holes in the lower chord. The connectors are selectively positionable within the holes along the upper and lower chords to adjust the space between the chords by changing the angle at which the diagonal supports are mounted relative to the upper and lower chords.

The invention is also a flying table comprising a flying table support, an adjustable depth truss mounted on the flying table support, and a form facing mounted on the adjustable depth truss. The adjustable depth truss is comprised of an upper chord and a lower chord, each of the chords having a plurality of holes spaced along the length thereof, and a plurality of diagonal supports, each of the supports being mounted at one end to a connector received within one of the holes in the upper chord and at the other end to a connector received within one of the holes in the lower chord. The connectors are selectively positionable within the holes along the upper and lower chords to adjust the space between the chords by changing the angle at which the diagonal supports are mounted relative to the upper and lower chords.

The invention is also a method for adjusting the depth of a truss comprising removing the connectors along one of the chords of the truss for all diagonal supports joining the chord at substantially the same angle, changing the depth of the truss, and reconnecting the diagonal supports to the chord by inserting the connectors at a different point along the chord.

DESCRIPTION OF PREFERRED EMBODIMENT

Figure 1:
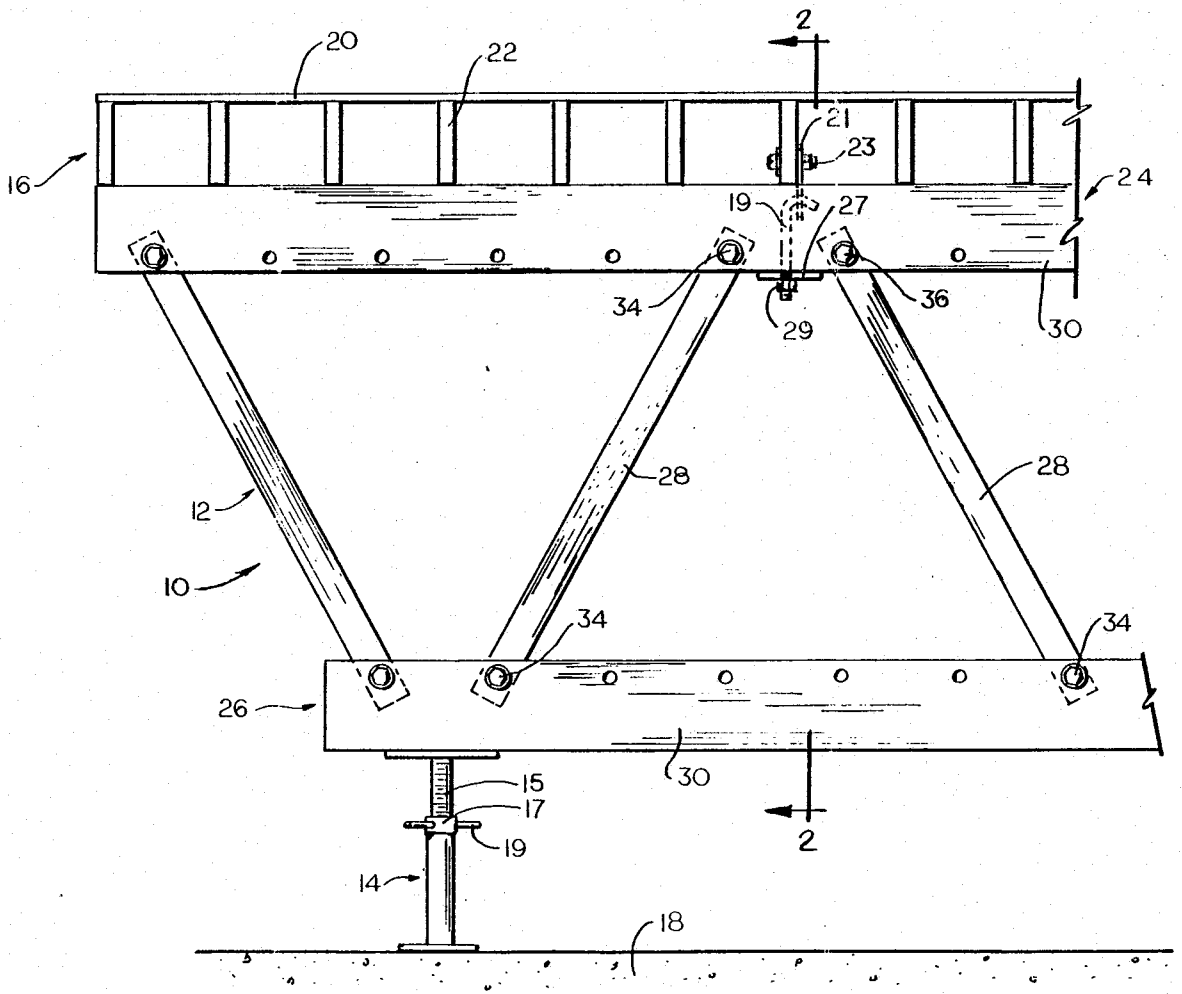
FIG. 1 is a side elevational view of the adjustable depth truss of the present invention.

Referring to FIG. 1, a portion of a flying table, labeled generally as 10, is shown supported by an adjustable depth truss, labeled generally as 12, constructed according to the teachings of the present invention. A form, indicated generally at reference numeral 16, is supported by the adjustable depth truss 12 and jack 14. The jack 14 rests on a support surface 18 and is provided with a threaded extension arm 15 and threaded collar 17. Threaded collar 17 is turned by lever arm 19 to adjust the height of the jack. The support surface 18 is normally the floor of the building or the previously poured floor.

The form 16 is also comprised of a facing 20 supported by integral joists 22. Facing 20 and joists 22 are assembled to the top chord 24 of adjustable depth truss 12 by hook rod 19 received within a hole (not numbered) in bracket 21 which is secured to joist 22 by bolt 23 through one of the holes 32 spaced therealong. The other end of hook rod 19 is secured to the plate 27 straddling the planks 30 comprising upper chord 24 by nut 29. The joists 22 are identical to the planks 30 of upper and lower chords 24 and 26, respectively, as will be discussed.

Figure 2:
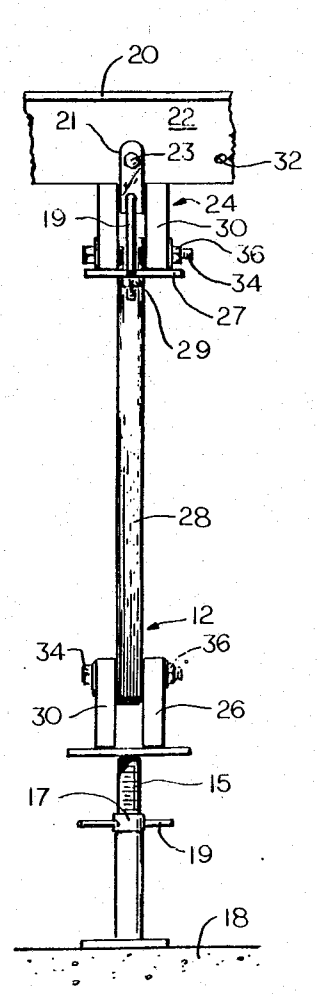
FIG. 2 is a cross sectional view of the adjustable depth truss of FIG. 1 taken along the lines 2—2 in FIG. 1.

The adjustable depth truss 12 is comprised of an upper chord 24, a lower chord 26 and diagonal supports 28. Referring to FIG. 2, it can be seen that the upper chord 24 and lower chord 26 are comprised of a pair of identical planks 30. Each plank 30 is provided with a plurality of holes 32 spaced therealong. Holes 32 are aligned so that the diagonal supports 28, which have a hole (not numbered) at each end, can be mounted to planks 30 by connectors inserted through the aligned holes 32 and the hole in diagonal support 28. Depending on the load on truss 12, it may be necessary to add sleeves (not shown) to holes 32. The connector 34 in the presently preferred embodiment is a bolt 34 held in place by a nut 36.

Figure 3:
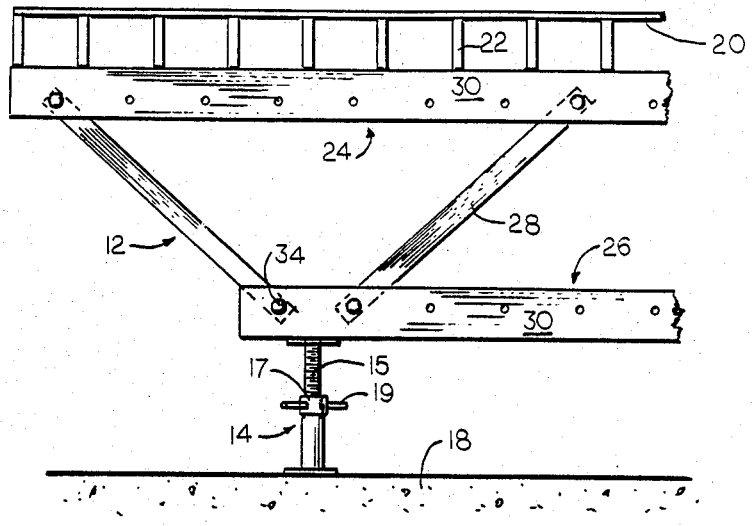
FIG. 3 is a side elevational view of the adjustable depth truss of FIG. 1 in a first position.
Figure 4:
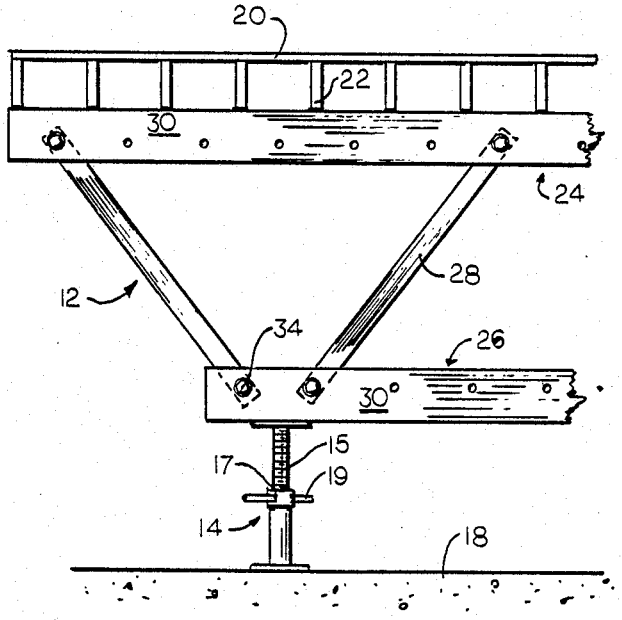
FIG. 4 is a side elevational view of the adjustable depth truss in FIG. 1 in a typical second position.

The space between chords 24 and 26 of the adjustable depth truss 12 can be varied by removing bolts 34 from holes 32, moving one of the chords 24 or 26 to change the space therebetween, and replacing bolts 34 in different holes 32 to change the angle at which diagonal supports 28 are mounted to the chords 24 and 26. There are multiple positions of the same length diagonal supports 28, depending upon the placement of bolts 34 in holes 32. For instance, in FIG. 4 the depth of adjustable depth truss 12 is deeper than the depth of the adjustable depth truss 12 shown in FIG. 3, because the diagonal supports 28 of the adjustable depth truss of FIG. 3 are mounted in holes 32 spaced farther apart along upper chord 24 than the spacing of the bolts 34 along the upper chord 24 of the adjustable depth truss 12 shown in FIG. 4. It can also be seen that the some procedure could be used to quickly collapse the truss 12 for transportation of the flying table 10 because the diagonals will nest between the planks 30 of the chords 24 and 26.

Although the invention has been described in the above preferred embodiment, it is understood that variations and modifications could be made by those skilled in the art who have the benefit of this disclosure which would fall within the scope of the present invention as set out by the following claims.

I claim:

1. An adjustable depth truss comprising:

first and second chords, each of said chords having a plurality of pre-existing holes therethrough spaced along the length thereof;

a plurality of diagonal supports, each of said diagonal supports having a hole at each end thereof;

a first set of connectors selectively positioned within a first set of the pre-existing holes in said chord; and a second set of connectors positioned within a selected set of the pre-existing holes through said second chord, said first set of connectors being received within the holes at one end of each of said diagonal supports and said second set of connectors being received within the holes at the other end of each of said diagonal supports, said first set of connectors being selectively positionable in any one of a plurality of second sets of the pre-existing holes in said first chord for changing the angle at which said diagonal supports are mounted relative to said first and second chords to provide multiple positions and angles of said diagonal supports for adjusting the space between said first and second chords without changing the length of said diagonal supports or changing the hole in said diagonal supports in which said first and second set of connectors are received.

2. The truss of claim 1 wherein said first and second chords are each comprised of opposed planks.

3. The truss of claim 2 wherein the holes of said first and second chords comprise aligned holes through each of the planks of said chords.

4. The truss of claim 1 wherein said chords and diagonals are comprised of laminated veneer lumber.

5. The truss of claim 1 additionally comprising a form, said form, said first and second chords, said diagonal supports, and said and first and second sets of connectors comprising a flying table.

6. The truss of claim 5 wherein said form comprises a facing supported by a plurality of joists assembled to said first chord.

7. The truss of claim 6 wherein said first and second chords are each comprised of opposed planks having a plurality of holes therein, the holes in each of the planks being aligned with the holes in the other plank for receiving said connectors.

8. The truss of claim 7 wherein the planks of said first and second chords are interchangeable with the joists of said form.

9. The truss of claim 8 wherein said form is assembled to said first chord by means received within the holes in the joist.

10. The truss of claim 9 wherein said assembling means comprises a hook rod.

11. The truss of claim 10 wherein one of said hook rod is received within a hole in a bracket, said bracket being secured to one of the joists of said form by a bolt received within one of the holes in the joist.

12. The truss of claim 11 wherein said hook rod is assembled to said first chord by a plate straddling the planks of said first chord, said plate releasably engaging said hook rod.

* * * * *